US008230648B2

(12) United States Patent
Bulloch

(10) Patent No.: US 8,230,648 B2
(45) Date of Patent: Jul. 31, 2012

(54) UTILITY LAND ANCHOR

(76) Inventor: Scott E. Bulloch, St. George, UT (US)

( * ) Notice: Subject to any disclaimer, the term of this patent is extended or adjusted under 35 U.S.C. 154(b) by 267 days.

(21) Appl. No.: 12/803,929

(22) Filed: Jul. 8, 2010

(65) Prior Publication Data

US 2010/0300017 A1 Dec. 2, 2010

Related U.S. Application Data

(63) Continuation-in-part of application No. 12/151,288, filed on May 6, 2008, now abandoned.

(51) Int. Cl.
*E02D 5/74* (2006.01)
*B63B 21/00* (2006.01)

(52) U.S. Cl. ..... 52/157; 52/153; 52/155; 114/230.1; 114/230.23

(58) Field of Classification Search ..... 52/153, 52/155, 157; 114/230.1, 230.2–230.3, 294–311; 173/91, 213; 175/19, 170; 405/224, 252.1, 405/259.1

See application file for complete search history.

(56) References Cited

U.S. PATENT DOCUMENTS

| | | | | | |
|---|---|---|---|---|---|
| 3,986 | A | * | 4/1845 | Mitchell | 52/157 |
| 88,891 | A | * | 4/1869 | McMahen | 175/91 |
| 598,003 | A | * | 1/1898 | Oliver | 52/154 |
| 633,574 | A | * | 9/1899 | Densmore | 74/578 |
| 857,751 | A | * | 6/1907 | Parker | 52/156 |
| 1,195,724 | A | * | 8/1916 | Preston | 175/170 |
| 1,373,560 | A | * | 4/1921 | Holland | 52/153 |
| 1,800,504 | A | * | 4/1931 | Chance | 52/157 |
| 2,320,612 | A | | 6/1943 | Kandle | |
| 2,352,326 | A | * | 6/1944 | Kandle | 175/242 |
| 2,846,192 | A | * | 8/1958 | Ostling | 175/18 |
| 2,964,115 | A | * | 12/1960 | Clatfelter | 175/40 |
| 3,011,598 | A | | 12/1961 | Galloway et al. | |
| 3,063,402 | A | * | 11/1962 | Vallquist | 440/34 |
| 3,148,510 | A | * | 9/1964 | Sullivan | 405/259.1 |
| 3,838,657 | A | * | 10/1974 | Fleming | 114/230.22 |
| 3,850,128 | A | * | 11/1974 | Lovell | 114/295 |
| 3,961,671 | A | * | 6/1976 | Adams et al. | 173/1 |
| 3,971,329 | A | * | 7/1976 | Kosmatka | 114/230.22 |
| 4,057,114 | A | * | 11/1977 | Anderson | 173/26 |
| 4,161,922 | A | * | 7/1979 | Fogg | 114/297 |
| 4,334,392 | A | * | 6/1982 | Dziedzic | 52/157 |
| 4,387,483 | A | * | 6/1983 | Larrabee | 16/422 |
| 4,702,047 | A | * | 10/1987 | Stokes | 52/156 |

(Continued)

FOREIGN PATENT DOCUMENTS

JP 05239983 A * 9/1993

*Primary Examiner* — Robert Canfield
*Assistant Examiner* — Charissa Ahmad
(74) *Attorney, Agent, or Firm* — M. Reid Russell

(57) ABSTRACT

A utility land anchor for mooring a water craft to a shore or beach or to act as a ground anchor to pull an object, such as an ATV, thereto, that includes a straight shaft that is pointed on one end and is arranged for connecting to a torque producing device, such as a handle or sided driver, on its other end. The shaft includes an auger secured adjacent to the pointed end, and is to loosely fitted into a cylindrical tube wherefrom blades or fins are attached to extend oppositely outwardly from the cylindrical tube sides that are sloped outwardly to facilitate travel into the shore, beach or ground, and a mooring line connector is secured to the cylindrical tube, adjacent to a lower end thereof.

12 Claims, 5 Drawing Sheets

U.S. PATENT DOCUMENTS

| | | | | |
|---|---|---|---|---|
| 4,858,876 | A * | 8/1989 | Moreno | 248/545 |
| 5,322,386 | A * | 6/1994 | Trangsrud | 405/19 |
| 5,699,864 | A | 12/1997 | Dvorak et al. | |
| 5,996,705 | A * | 12/1999 | Downs | 172/371 |
| 6,237,289 | B1 * | 5/2001 | Jewett et al. | 52/163 |
| 6,481,364 | B2 * | 11/2002 | Woyjeck | 114/294 |
| 6,820,573 | B1 * | 11/2004 | McMullin | 119/791 |
| 6,824,331 | B2 * | 11/2004 | Parker | 405/259.1 |
| 6,899,187 | B1 * | 5/2005 | McCarthy | 175/19 |
| D546,167 | S * | 7/2007 | Noethe | D8/349 |
| 7,270,073 | B1 * | 9/2007 | Waldrop et al. | 114/295 |
| 7,887,263 | B2 * | 2/2011 | Moffat | 405/259.1 |
| 8,096,368 | B1 * | 1/2012 | Rider | 173/1 |
| 2003/0147704 | A1 * | 8/2003 | Parker | 405/259.1 |

* cited by examiner

UTILITY LAND ANCHOR

This application is a continuation-in-part application of an application Ser. No. 12/151,288 for a "BOAT ANCHOR" filed on May 6, 2008, that is abandoned with the entry of this CIP application.

BACKGROUND OF THE INVENTION

1. Field of the Invention

This invention relates to land anchors that are turned into a beach or into soil for holding a boat to the shore, or as an anchor point for pulling a vehicle.

2. Prior Art

Previously land anchors, and boat shore anchors in particular, have generally consisted of large heavy weights for positioning on a shore that are connected to a floating device, such as a boat, by a line. The function of such anchors, like the invention, is to prohibit a floatation device, such as a boat, from floating away from the shore. Additionally, the anchor of the invention is useful for providing a land anchor point for pulling an item, such as an ATV, towards it. The majority of boat anchors are designed to work by submerging the anchor into water that attaches, by a line, chain, or the like, to a floating device. Such anchors have protruding arms or mechanical devices designed to either dig into the lake or sea bottom or catch outcrops at the bottom of the body of water. Land anchors are usually posts arranged to be pounded into the ground that include an attachment device, such as an ring, eyelet, pulley, or the like, that a cable is attached to, that has been un spooled from a winch mounted to the vehicle, such as an ATV, whereby, with the winch operated, the cable is reeled in, pulling the vehicle to the post.

In practice, an anchor, like the invention, is utilized by a water craft that has been moved near to a shore or beach that does not have a permanently fixed structure. I such situation, traditional anchors are not satisfactory to stabilize a boat to the shore. For such shore anchoring, where permanently fixed structures are not available, boat owners have generally attempted to secure the boat to the shore in variety of ways, that, in practice, may not adequately hold the boat, allowing it to drift away and/or be damaged. A general practice for securing a boat to a shore or beach has consisted of hammering a large stake or stakes into the shore or beach for receiving lines from the boat. Such stakes, however, have substantial drawbacks in that, unless the stakes are driven very deep, it or they can easily break free failing to adequately secure the boat. Whereas, if the stakes are deeply driven, removing the stakes takes great effort.

Another common practice as has been employed by boat owners to anchor a boat to a shore is to take a traditional boat anchor, place it into a hole and fill the hole with sand from the shore. This method has the same limitations as driving stakes into the ground. To properly secure the boat, the hole has to be deep enough to provide enough resistance to the forces as are applied to the boat, such as tides, winds and wave action, to hold the boat in place. This is also true for land anchors where, if a stake, or the like, is driven into the ground and connected to a cable end that is winched in to move a vehicle, such as an ATV, towards it, the stake will pull out of the ground. The present invention to provide a reliable land anchor, includes an auger mounted onto a shaft that is fitted through a sleeve. The shaft is turned by a handle or motor driven ratchet arrangement, turning the auger into the ground. The sleeve includes at least a pair of blades or fins that each project outwardly from opposite sides of the sleeve outer surface. In operation, the auger to pulls the sleeve and fins into the ground. The auger depth, connection of a mooring line to a bottom end of the sleeve, all contribute to maintaining the assembly in the ground when it is subjected to a load, such as a boat connected through a line to the sleeve base, or the pulling load exerted through a winch cable attached to the sleeve base end surface for pulling a vehicle, such as an ATV, towards the assembly. The invention, provides for mounting a line to a base end of the sleeve that is pulled into the ground by turning the auger, and that line buried alongside of the sleeve. When a pulling force is exerted thereon, that force first pulls the line towards the applied force. The stretched line then tends to try to pull the anchor bottom end through the sand or dirt with the blades or fins resisting that movement. In practice, the anchor will hold fast against a force that is up to twice the load the anchor will hold against when the line is connected to a mounting ring located at the top of the sleeve.

Additionally, unlike prior anchors, the anchor of the present invention optionally includes blades or fins as are mounted to the anchor sleeve that face oppositely, and form an angle of less than one hundred eighty degrees towards the pulling force, providing a cupping action when a pulling force is applied at the sleeve bottom end. That cupping action tends to compress the ground ahead of the anchor towards the pulling force, holding the anchor in place, discouraging the anchor lower end from being pulled out of the ground.

Also unlike prior anchors, the line end mounting to the lower end of the sleeve that is pulled into the ground by the auger, positions the line alongside of the anchor of the invention to be proximate to the ground surface. That line attachment causes the line to straight at an angle from the anchor shaft from its attachment point towards the pulling force, holding it in place against being pulled out of the ground even with an application of a pulling force through the line that is greater than twice an anchor where the line is attached to the top of the sleeve will sustain. Additionally, the present invention includes a mooring line locking device for prohibiting an anchor line pulled through the lower line mounting from passing back towards the item to be held or drawn thereto, and is easily released.

For various reasons a boat or land anchor may be required to be moved several times in a short period of time. Prior to the invention, the early anchors set out above have required considerable effort and time to install and remove, and none have provided the stability to anchor a heavy object, such as a boat, or to act as an anchor point for a winch cable to draw a vehicle, such as an ATV, towards the anchor.

SUMMARY OF THE INVENTION

The invention relates to devices for anchoring a boat or other floatation device to a shore or beach, and can also be used as a ground anchor that a cable is attached to resist removal when a vehicle, such as an ATV is drawn towards it. The invention includes a shaft with an auger or screw located at a lower end of the shaft. The opposite or top shaft end is provided with a device for creating torque. Such devise for providing torque may be either a hand bar or a power device for turning a driver that has been fitted into a cavity formed into the shaft top end.

A cylindrical tube or sleeve is provided for fitting over the shaft top end so as to slide along the shaft, for positioning between the auger or screw top end, and the opposite shaft top end, and has an inner diameter that is sufficiently greater than the shaft diameter to allow for free passage of sand and small rocks out from between the shaft and tube or cylinder inner surface. Multiple blades or fins are attached to the outside of the cylindrical tube or sleeve to extend outwardly and the blades or fins may be less than one hundred eighty degrees in arc in the direction a line that is extended out from the anchor. Which blades or fins arrangement is to encourage ground to collect and compress against a pulling force exerted on the anchor holding a boat, or when the anchors is attached to a winch cable for drawing a vehicle towards it. The anchor cylindrical tube or sleeve has a line mounting at its lower end, for attaching the line, that may consist of holes formed through the blades or fins, adjacent to their attachment points, to the cylindrical tube or sleeve sides. Which holes allow for passage of a mooring or winch line around the cylindrical tube or sleeve. Or the line mounting may include a mounting ring, or other device, attached to the cylindrical tube or sleeve outer surface.

A self locking device can be fitted to the cylindrical tube or sleeve top end to pull the mooring line through for holding the mooring line in place after its pulled tight. A come-along or other like device can be attached to a loop end of a section of the mooring line whose other end attaches to the cylindrical tube or sleeve mount. The mooring line from the boat is pulled through the loop, pulling the loop towards the boat, and which loop can attach to a hook end of a winch line for drawing a vehicle, such as an ATV, or the like thereto.

A torque applied to the shaft turns the auger to dig or screw the shaft auger end into the shore, beach or dirt, pulling the blades or fins extending out from the cylindrical tube or sleeve outer surface into the shore or beach. So installed, the blades or fines, that are preferably at an angle of less than one hundred eighty degrees, provide surfaces to gather the beach material or dirt as a pulling force is directed into the anchor, utilize the resistance of the gathered materials to prevent the anchor from being pulled out. Which resistance of the anchor from been pulled out is further enhanced by connection of the mooring or winch line to the cylindrical tube or sleeve bottom end, with the line being pulled into the ground as the auger is turned. Whereby, when a pulling force is applied to the winch line, that winch line is pulled away from the anchor, forming an angle thereto to the applied force Thereby, the pulling force will act on the anchor lower portion against the dirt along the winch line, essentially doubling the pulling force as can be applied to the anchor before is pulls out. After use, the anchor is removed by reversing the torque direction applied to the shaft, with the arguer blades pushing the blades or fins out of the soil. In which anchor removal some materials may be lodged in the space between the shaft and cylindrical tube or sleeve. To facilitate removal thereof, the cylindrical tube or sleeve preferably includes a longitudinal slot or slots that facilitate materials removal as by rinsing the anchor in water.

It is a principal object of the invention to provide a utility land anchor with installed mooring line that is easily, efficiently and securely turned into a shore, beach or other ground for anchoring a water craft, or is for use as an anchor point that a cable attaches to for drawing a vehicle, such as an ATV, thereto.

Another object of the invention is to provide an anchor that is easily installed and removed from the shore, beach or ground that, by a placement of a mooring or winch line connection point at a lower end of a cylindrical tube or sleeve mounting blades or fins, when sleeve and blades are pulled by the turning auger into the ground, the mooring or winch line, when placed under tension will tend to pull away from the anchor, and the applied tension on the mooring or winch line will try to pivot the anchor bottom end at an angle to the ground, requiring that an applied tension sufficient to lift the anchor bottom end to follow the applied tension, being essentially twice that as required to pull out the anchor where the connection point is at the top of the anchor cylindrical tube or sleeve.

Another object of the invention is to provide a spacing distance between the anchor shaft and sleeve interior to allow for free passage of sand and small rocks out of the sleeve so as to facilitate cleaning debris out from between the opposing shaft and sleeve walls.

Still another object of the invention is to provide an anchor whose auger end can be turned manually or by a driver for applying a torque to turn an anchor sleeve to turn the anchor into a shore. beach or ground, pulling blades or fins therewith that extend outwardly from the outer surface of the cylindrical tube or sleeve, into the shore, beach or ground, for securely holding the anchor in the shore, beach or ground, and is easily removed by applying a reverse torque to the auger, turning it out of, and releasing it from the shore, beach or ground.

DESCRIPTION OF THE DRAWINGS

The invention may take form in the arrangement of component parts that are herein shown as preferred embodiments and will be described in detail and illustrated in the accompanying drawings which form a part hereof.

DETAILED DESCRIPTION

Figure 1:
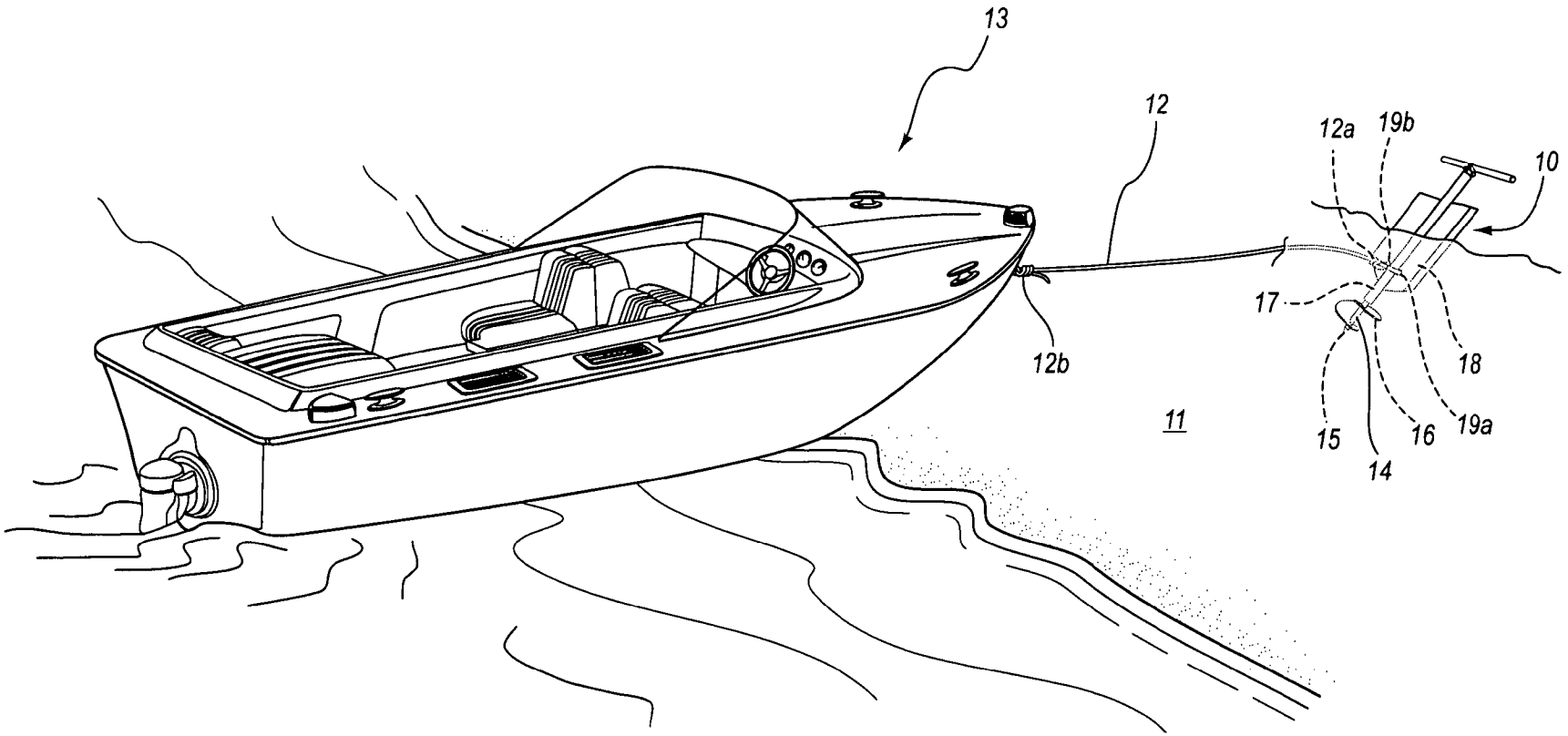
FIG. 1. Shows a typical use of a utility land anchor of the invention for mooring a boat to a shore or beach.

A first embodiment of a utility land anchor 10 of the invention, hereinafter referred to as anchor, is illustrated in FIG. 1, that shows the anchor 10 as having been turned into the shore or beach 11 by turning an auger 16 secured onto the end of a cylindrical tube or sleeve 17 that a shaft 14 having a pointed end 15 is fitted through, and shows a mooring line 12 mounted to a lower end of the cylindrical tube or sleeve 17 that mounts blades or fins 18 that extend outwardly therefrom as having been pulled into the earth, following the auger. An outer end of the mooring line 12 is shown attached, at 12*b*, to a water craft, shown as a boat 13. In practice, a number of spaced apart anchors 10 may be utilized to secure different sections of the boat 13 to the shore, and, of course, the anchor 10 may be utilized to secure any type of floatation device, and may, as set out below be utilized as a ground anchor for attaching a winch line, or the like, to the anchor lower portion, for drawing a vehicle, such as an ATV towards the anchor.

Figure 2:
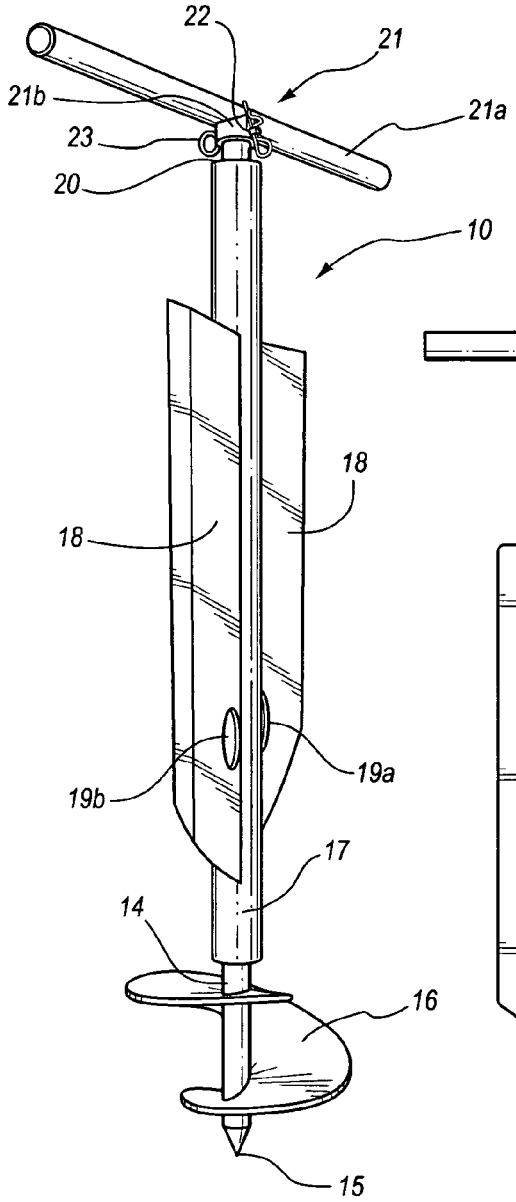
FIG. 2. Shows a profile perspective view of the utility land anchor of FIG. 1.

FIG. 2 shows an overall view of the anchor 10 as comprising a vertical shaft 14 that extends the entire length of the anchor 10. A pointed tip 15 is formed at the end of the shaft 14 that assists in inserting the vertical shaft 14 into the ground 11. Proceeding upwards along the longitudinal axis of the vertical shaft 14, auger or screw 16, hereinafter referred to as auger, is attached to the shaft 14, and is shown as having two screw turns or vertical revolutions about the shaft 14, and is spaced apart from the pointed tip 15. It should, however, be understood that the auger 16 may have only one turn, or more than two turns of vertical revolutions about the shaft 14, within the scope of this disclosure.

Figure 4:
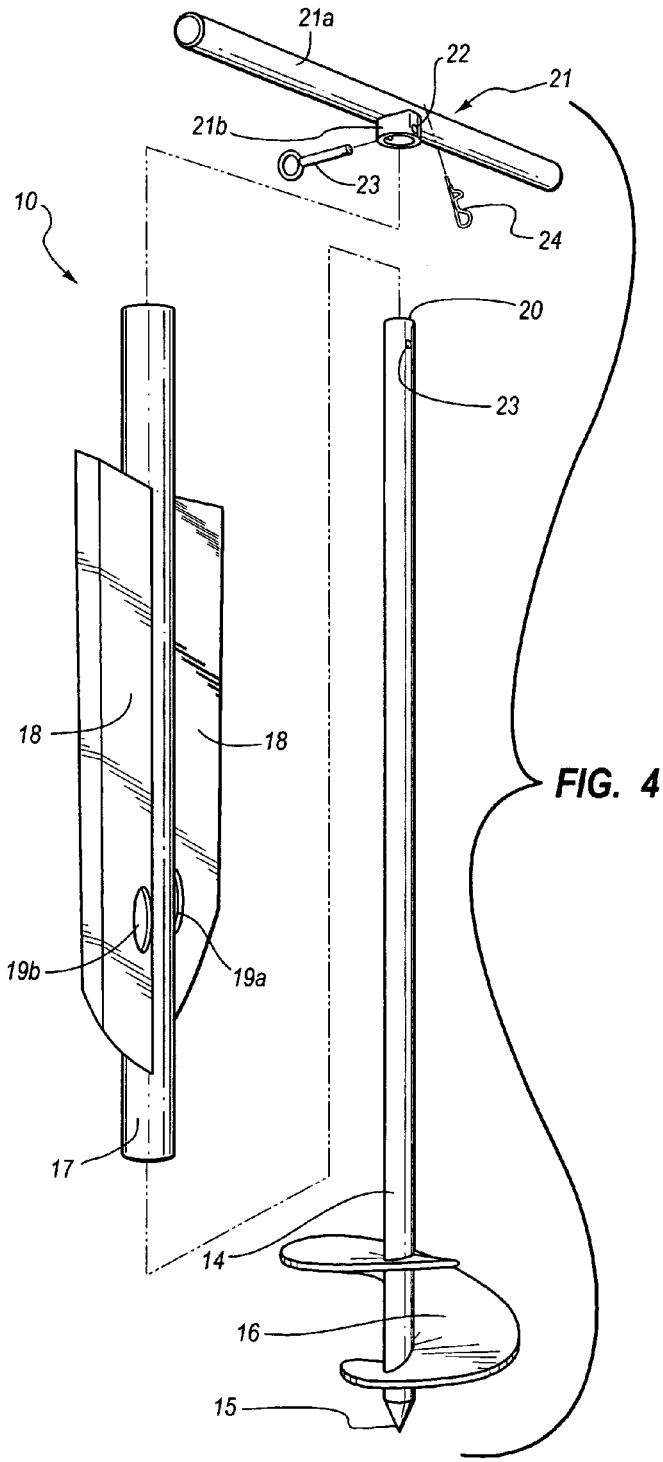
FIG. 4. Shows an exploded view of the utility land anchor of FIG. 2, illustrating how an anchor shaft slides through a cylindrical tube or sleeve, and shows a hand bar aligned for attachment to the top of the shaft.

The cylindrical tube or sleeve 17, hereinafter referred to as sleeve, is fitted over the shaft 14, above the auger 15, to slide freely along the shaft, and is shown in FIG. 4, as having been exploded therefrom. The sleeve 17 slides freely along the longitudinal axis of the shaft 14 and its inner wall is spaced apart from the shaft 14 outer surface a minimum distance, as discussed below with respect to FIG. 7. The spacing distance provides an open area between the opposing surfaces of the shaft 14 and sleeve 17 that allows water and debris to freely travel out of the anchor 10, during its removal from a shore, beach or ground, preventing corrosion on the anchor.

Figure 10:
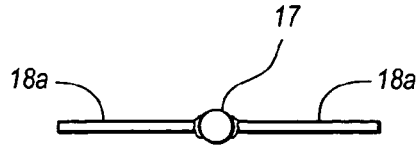
FIG. 10. Shows a top view of the cylindrical tube or sleeve and blades or fins of FIG. 8, where the blades or fins are in the same plane.
Figure 11:
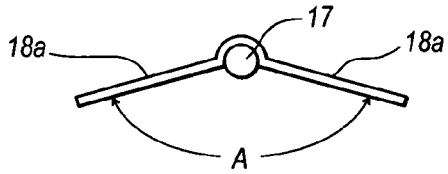
FIG. 11. Shows a view like that of FIG. 10, only showing the blades or fins edges connected to the cylindrical tube or sleeve to form an angle of less than one hundred eighty degrees across the direction that a tensile force is applied to the mooring line.

The blades or fins 18*a* are attached, as by welding, to extend outwardly from opposite sides of the sleeve 17, aligning with the sleeve longitudinal axis. FIG. 10 illustrates a co-planar alignment of the blades or fins 18*a* extending from sleeve 17, and FIG. 11 illustrates that formation of the blades or fins from a single section for longitudinal bending along the section center axis partially around the sleeve 17, and welding to the sleeve 17 to form an angle of less than one hundred eighty degrees, as discussed below. FIGS. 2 through 6 show two blades or fins 18 connected to extend oppositely from the longitudinal axis of the sleeve 17. It should, however, be understood, more than two such blades or fins, that are each connected along the sleeve longitudinal axis, and are spaced apart, may be used, as described, within the scope of this disclosure. The blades or fins 18 will generally extend outwardly from along the majority of the length of the longitudinal axis of the sleeve 17. The portion of each of the blades that is nearest to the auger 16 are preferably tapered outwardly from their lower ends. That taper is to assist the travel of the blade or fin into the beach or shore, as shown in FIG. 1, and the blades or fins may be another shape, for example, the shape shown in FIG. 8, within the scope of this disclosure.

Figure 6:
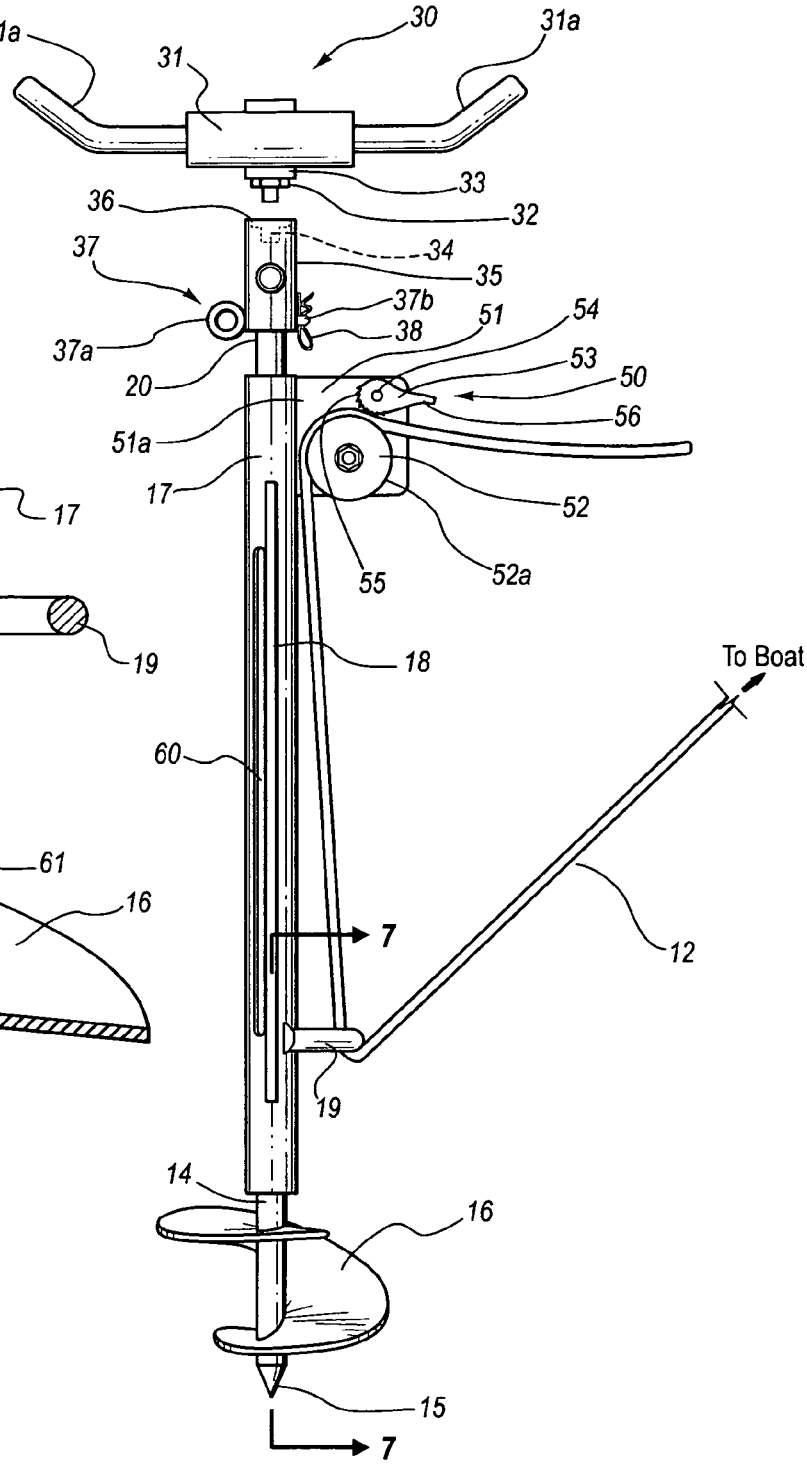
FIG. 6. Shows a side elevation view of the utility land anchor of the invention as including a drive adapter that is capable of applying a rotational torque to a drive cavity arranged on an anchor shaft head end, shows an anchor cylindrical tube or sleeve as including a longitudinal slot, and shows a mooring line fitted through a mounting ring and extending from the anchor cylindrical tube or sleeve bottom end to ground level that connects to a boat, and shows the mooring line being fed through a locking device that is mounted to the top of the anchor cylindrical tube or sleeve.

A mooring ring 19 is shown in FIG. 6, attached to the outer surface of the cylindrical tube 17, proximate to a bottom end thereof, that is to receive the mooring line 12 fitted thereto, that, as shown, has its opposite connected to a boat, as illustrated with an arrow. That mooring line 12 is passed upwardly from the mooring ring 19 for threading through a mooring line connection device 50 that is mounted onto a top end of cylindrical tube 17 and consists of a body 51 that is connected along its edge 51*a* to the side of the cylindrical tube 17, extending outwardly therefrom. A guide pulley 52 is mounted to the side of the body 51 at a bearing to turn freely and receives the mooring line 12 that is passed across a guide pulley 52, and passe across a pawl 53 that is connected at 54 to the side of the body 51, adjacent to the guide pulley 52. The mooring line connection device 50 is for taking up slack and holding the connecting line 12 in place after it has passed therethrough. The pawl 53 is connected at 54 to the side of the body 51, to pivot pawl teeth 55 into engagement with the mooring line 12 surface when a pawl trigger 56 is moved towards a section of the mooring line 12 that has passed over the pulley sheave 52*a*. So arranged, the mooring line 12 end section opposite to the line coupling to a water craft, is fitted in the pulley sheave 52*a*, around the guide pulley 51, and passes freely between the pawl teeth 55 and the pulley sheave 52*a*, resisting being pulled back through the mooring line connection device as could release the water craft. With the mooring line 12 taut from the mooring rin 19, the pawl trigger 56 is depressed towards the mooring line 12, causing the pawl teeth 54 to engage and lock into the mooring line. To release which mooring line 12. the pawl trigger 56 is lifted off or the mooring line 12, releasing the pawl teeth 55 from the mooring line 12 that can then pass back around the guide pulley 52, releasing the mooring line that is pulled out from the mooring ring 19.

Figure 8:
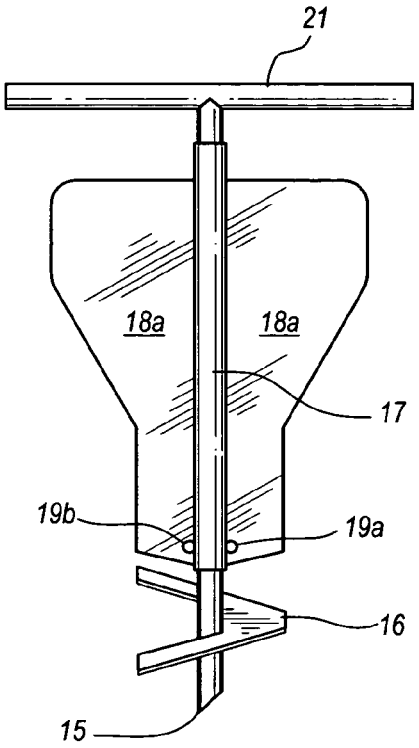
FIG. 8. Shows another embodiment of the utility land anchor of the invention that includes blades or fins that extend oppositely outwardly from the cylindrical tube or sleeve sides with the blades or fins outer edges each stepped inwardly from the parallel blade top sections to parallel base bottom sections, shows an auger secured to a shaft lower end and has a handle secured to the shaft top end.
Figure 9:
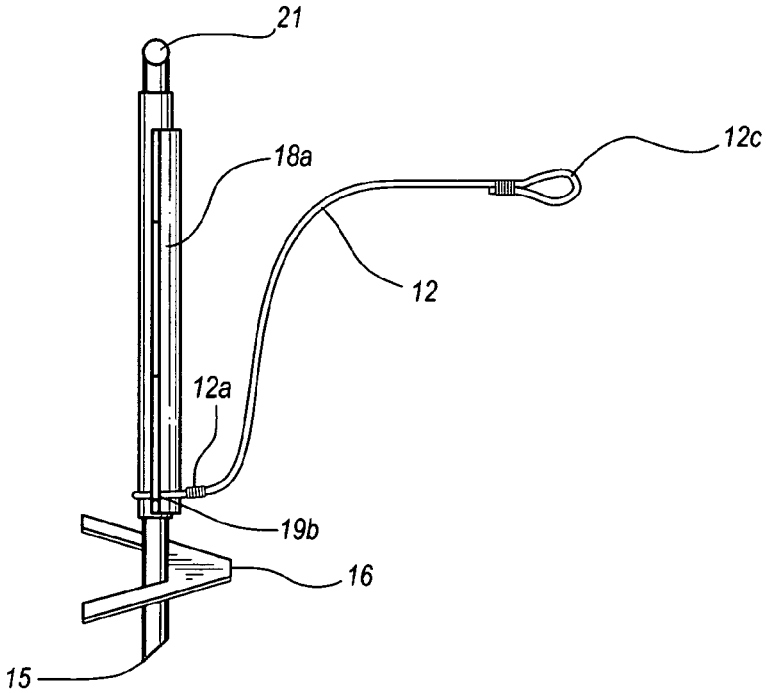
FIG. 9. Shows a side elevation view of the utility land anchor of FIG. 8 as including a mooring line lower end passed through a first of aligned holes formed through the blades or fins proximate to the blades or fins welds to the cylindrical tube or sleeve, over the cylindrical tube or sleeve surface and out the second of the aligned holes and shows the mooring line end joined onto the mooring line that includes a loop on its other end.

An alternative to the moor ring 19, as a mooring line connection device, is shown in FIGS. 1 through 4, 8 and 9, that is also for receiving the mooring line 12, and consists of a pair of horizontally aligned holes 19*a* and 19*b* that are individually formed through each of the blades or fins 18, shown in FIGS. 1 through 4 and blades or fins 18*a*, shown in FIGS. 8 and 9. One of which holes 19*a* or 19*b* receives the mooring line 12 end fitted therethrough, that passes around the sleeve 17 and out the other hole 19*a* or 19*b*, and is secured, shown at 12*a* in FIGS. 1 and 9, to the mooring line. Holes 19*a* and 19*b*, unlike the mooring ring 19, provide minimum resistance to anchor travel into a beach or ground and are preferred except where the mooring line connection device 50 is employed. In practice, as shown in FIGS. 1 through 5, the turning of the handle 21 that is secured across a top end of the shaft 14, turns the auger 16 that is fixed onto the lower shaft 14 end portion, screwing the shaft pointed lower end 15 into the beach or ground. In which anchor 10 travel, the mooring line that has been attached through blade or fins 18 holes 19*a* and 19*b* is also pulled into the beach or ground, alongside the anchor 10. The mooring line 12, shown in FIG. 1, is then secured to boat 13, as shown at 12*b*, and drawn tight. In that drawing, the mooring line 12 will pull through the beach or ground, as illustrated in FIG. 6. With further tensioning on the mooring line 12, as from wave action on the boat, tending to act at the anchor 10 sleeve 17 lower end, to pivot that anchor lower end, trying to lift the anchor, lower end first, out of the beach or ground. In practice, the anchor 10 will have to rotate through undisturbed beach or ground and have to travel a greater distance, meeting a greater resistance, than where the anchor is pulled from its upper end. Which greater pull out strength has been found to be approximately twice as great for the anchor 10 of the invention over a mounting of the mooring line 12 to the top of an anchor. For convenience in stretching the mooring line 12 a loop 12*c*, shown in FIG. 9, can be formed in an outer end thereof for attachment to another section of mooring line that attaches to the boat. Which loop 12*c* can be connected to a come-along, or the like, not shown, that attaches to the other section of mounting line for applying tension to the mooring line.

Figure 7:
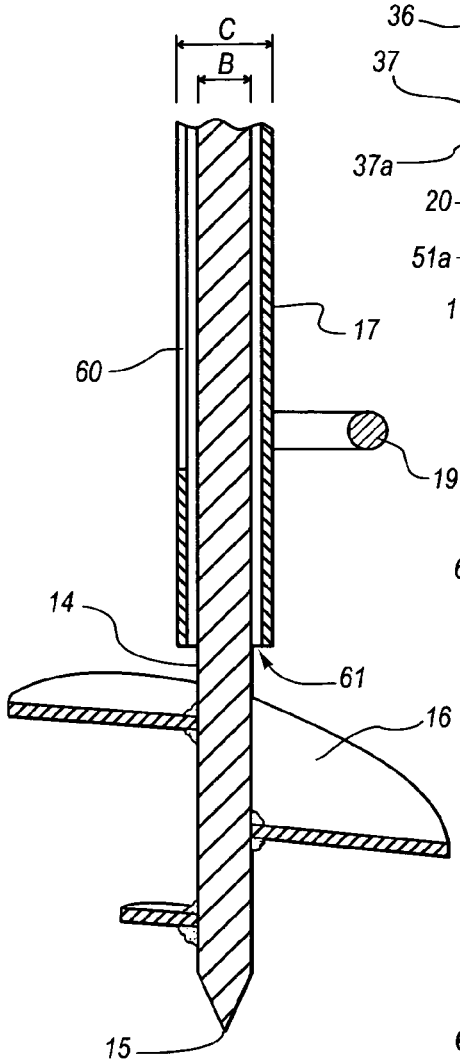
FIG. 7. Shows a profile sectional view taken along the line 7-7 of FIG. 6 illustrating the relationship of the outer and inner diameters, respectively, of the anchor shaft and cylindrical tube or sleeve, providing a desired gap between the shaft outer surface and the cylindrical tube inner surface suitable for cleaning out materials from therebetween.

It should be understood that the mounting ring 19 of FIGS. 6 and 7 and the side by side holes 19*a* and 19*b* formed through the blades 18 adjacent to their welds onto the sides of the sleeve 17 of FIGS. 1 through 4, and 8 and 9, serve the same function of attaching the mooring line 12 to the base of the sleeve 17, to be positioned below the beach or ground surface when the anchor 10 is turned into the beach or ground. The arrangement of side by side holes 19*a* and 19*b*, however, provides an arrangement that will produce less drag on the anchor 10 as it is turned into the beach or ground.

Figure 3:
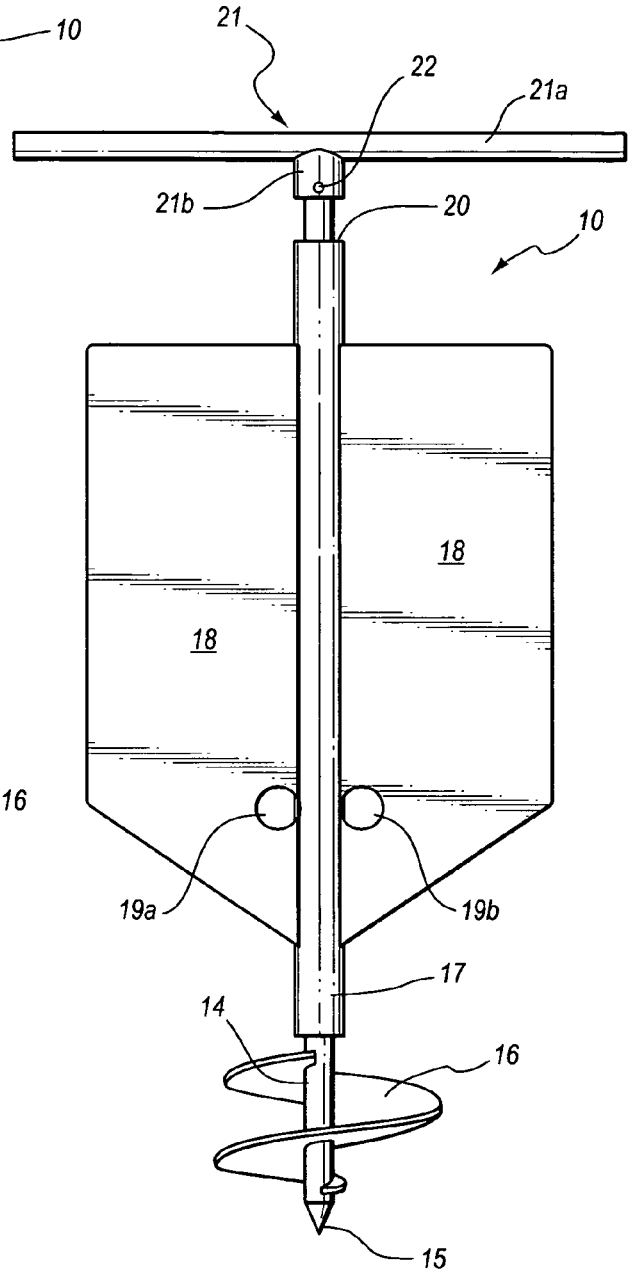
FIG. 3. Shows a front elevation view of the utility land anchor of FIG. 2.

The shaft 14 top end 20, opposite to the pointed shaft end 15, is to couple to a torque generation arrangement, that is shown as a hand bar 21, in FIGS. 2 through 4. Which coupling is shown in FIGS. 2 through 4, as a lateral hole 22 that receives a cotter pin 23, bolt or like connector, not shown. Whereas, in the arrangement of FIG. 6, the coupling is shown in broken lines as a sided hole 34, that receives a sided driver 32 fitted therein, as discussed below. Which coupling sided hole 34 allows for the attachment another device or devices, for creating torque on the shaft 14.

Shown best in FIGS. 2 through 4, the hand bar 21 includes a solid bar 21*a* that is secured at its mid point across a hollow collar 21*b*, and the hollow collar 21*b* includes the lateral hole 22 that cotter pin 23 is shown fitted through, mounting the hand bar 20 onto the shaft 14 top end 20. So arranged, the solid bar 21*a* is perpendicular to the longitudinal axis of the shaft 14, and the solid bar 21*a* length is determined by the amount of torque that is anticipated to be required to turn the auger anchor 10 shaft 14 into the shore, beach or ground. Different soils may require different length of hand bars 21 solid bars 21*a*. The hollow collar 21*b* is connected onto, to extend from the center of, the solid bar 21*a*, and the hollow collar 21*b* is perpendicular to the solid bar 21*a*. The lateral hole 22 in the collar 21*b* aligns across the center of the hollow collar with a hole 23 formed through the shaft 14, as shown in FIG. 4. With the hollow collar hole 22 and shaft hole 23*a* aligned, a cotter pin 24 is fitted therethrough, securing the hand bar 21 onto the shaft 14 top end 20.

FIG. 6 shows a power device 30 as an alternative to the hand bar 21. The power device 30 is shown as including a cylindrical center body 31 wherefrom hand engaging bars 31*a* extend from opposite ends of the cylindrical body 31. The power device has a sided drive 32 that is fitted through, to extend from, a center of a collar 33 that is secured to an undersurface of center body 31. The sided drive 32 is to fit into an axial sided cavity 34 formed into a top end 36 of an adapter 35 that is mounted onto the top end 20 of the shaft 14. Which coupling is illustrated as a pin 37 that is fitted through aligned holes through the adapter 35, and through the shaft hole 23*a*, as shown also in FIG. 4. As shown in FIG. 6, the pin 37 is for maintaining the adapter 35 onto the shaft 14 end 20, and includes a head end 37*a* for gripping by and operator, and a pin body 37*b* that is fitted through the aligned holes and has a lateral hole for receiving a straight leg of a clip 38 fitted therethrough. As shown, the power device drive 32, functions as a quick release coupling into the sided cavity 34 like a conventional socket drive and socket, for manual turning by an operator gripping the ends of the hand engaging bar 31*a*. While a manually operated power device 30 is shown in FIG. 6 for applying a torque to shaft 14, it should be understood that a motor for turning the device drive 32 along with a power source, such as a battery and switch, are within the scope of this disclosure. Whether manual or motor driven, the power device 30 provides for applying a torque to turn the shaft 14 as described.

In operation, the anchor 10 vertical shaft 14 end 15 is urged into the shore, beach or ground by creating rotational torque on the shaft 14 that causes the auger 16 to turn. When the turning auger 16 engages the surface of the shore, beach or ground it turns therein and, and, with continued turning, it pulls the sleeve 17 that includes the oppositely pointing blades or fins 18, into that shore beach or ground. Turning of the shaft 14 into the shore, beach or ground pulls the sleeve 17 to a depth where the blades or fins are at least partially buried and, preferably to where the blade or fins top edges align with the shore, beach or ground. When the sleeve 17 has been pulled by the auger into the ground to a desired depth, the torque applied to the auger 16 is stopped and the mooring line 12 is alongside of the sleeve, and travels along the shore, beach or ground, to the boat or for attachment to a second line that attaches to the boat. The mooring line 12 is then placed under tension, pivoting from its mounting to the sleeve 17, through the shore, beach or ground, as illustrated in FIG. 6 and as shown in FIG. 1. So arranged, a force from the boat through the mooring line 12 acts on the lower end of the sleeve 17, that tries to pull the auger 16 and lower end of the sleeve 17 out of the shore, beach or ground. To lift the anchor 10 auger 16 and sleeve 17 through the shore, beach or ground requires a greater pulling force than would be required to topple the anchor from its top end. Accordingly, the anchor 10 will exhibit a greater resistance to be pulled out of the shore, beach or ground than earlier anchors. To provide the anchor 10 with additional pull-out strength, the blades or fins 18*a*, as shown in FIGS. 8 through 11, can be mounted to the sleeve 17 to be at an angle A, shown in FIG. 11, that is less than one hundred eighty degrees. So arranged, when a pulling force is applied through the sleeve 17, as set out above, the blades or fins 18*a* that are across that pulling force, will tend to gather the material of the shore, beach or ground, tending to collect and compress that material, prohibiting the anchor from rotating out of the shore, beach or ground at its auger 16 end. In practice, the angle A can be from one hundred seventy nine to ninety degrees within the scope of this disclosure to provide an increase in pull-out strength to the anchor 10.

Figure 5:
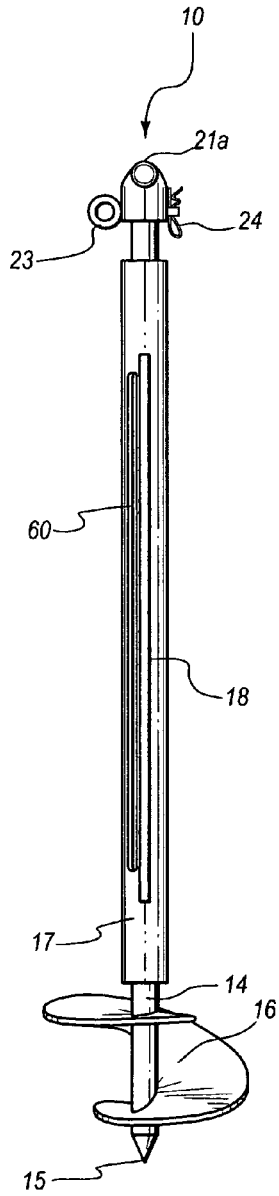
FIG. 5. Shows a side elevation view of the utility land anchor of FIG. 2.

In operation, applying a torque to the shaft 14 turns the shaft 14 and auger 16 into the shore, beach or ground, tending to pull the sleeve 17 therewith. In such drilling operations the shaft 14 and cylindrical tube or sleeve 17 travel into the shore, beach or ground, collecting debris between the opposing shaft and sleeve tube outer and inner surfaces, respectively, that, if not removed after the anchor 10 is turned out of the shore, beach or ground, may later hinder re-installation of the anchor 10. To facilitate such debris removal the sleeve 17, shown in FIGS. 5 through 7 is shown as including an optional longitudinal slot 60 that water may be passed through to clean out collected debris. Additionally, to further facilitate removal of debris from between the shaft 14 and sleeve 17 opposing surfaces, a space or gap 61, shown in FIG. 7, is provided between the opposing outer surface of shaft 14 and inner surface of sleeve 17. This space or gap encourages an out flow of collected debris material after removal of the anchor 10 from the shore. beach or ground. In practice, by a selection of a shaft 14 having an appropriate outside diameter B to accommodate the sleeve 17 that has an appropriate inside diameter C, with the shaft centered in the sleeve, an appropriate space or gap 61 is provided that is of a size to encourage discharge of collected debris after anchor 10 removal from the shore or beach. In practice, the respective diameters B and C of the shaft and cylindrical tube or sleeve are selected to provide a space or gap 61 of approximately one eighth to one half of an inch. Incorporation of the space or gap 61 will facilitate prevention of collected debris from remaining in the sleeve 17 as could cause undue friction between the shaft and the sleeve that could prevent the rotational movement of the shaft. In addition, the presence of space or gap 61 will assist in preventing the anchor material from corroding.

While a preferred embodiment of my invention in a utility land anchor has been shown and described herein, it should be understood, that although the description above contains many specificities, these should not be construed as limiting the scope of the embodiment but as merely providing illustrations of some of the presently preferred embodiment components. Thus, the scope of the embodiment should be determined by the appended claims and their legal equivalents, rather than by the examples given.

I claim:

1. A utility land anchor comprising, a vertical shaft having a first lower end and a second upper end, where said vertical shaft first lower end is shaped to have a pointed tip, and said vertical shaft first lower end includes an auger secured to an exterior surface of said shaft, adjacent to said pointed end, and said vertical shaft second upper end includes a center longitudinal cavity formed to receive a driver fitted therein; a cylindrical tube is provided to loosely fit over said vertical shaft between said first lower and second upper vertical shaft ends, in sliding relationship, and the interior diameter of said cylindrical tube is greater than the outside diameter of said vertical shaft, providing a space or gap between said cylindrical tube and said vertical shaft that is large enough to accommodate passage of debris, including small pebbles, from between opposing outer and inner surfaces of said vertical shaft and cylindrical tube; at least a pair of blades or fins that are spaced apart and are individually attached to extend outwardly from opposite sides of the exterior surface of said cylindrical tube, from a lower end thereof, and a mooring line attachment device is fixed to said cylindrical tube, adjacent to said blades or fins lower ends; and a torque producing device is arranged for connection to said vertical shaft second upper end, coupling into said center longitudinal cavity to provide a rotational torque to said vertical shaft.

2. The utility land anchor as recited in claim 1, further including the blades or fins are secured onto the cylindrical tube outer surface to be aligned and proximate to the lower end of said cylindrical tube and form an angle of less than one hundred eighty degrees to the mooring line attachment device that is centered between said blades or fins.

3. The utility land anchor as recited in claim 2, wherein the angle formed by the blades or fins is between one hundred seventy nine and ninety degrees.

4. The utility land anchor as recited in claim 1, wherein the interior diameter of the cylindrical tube is greater than the outside diameter of the shaft, providing a space or gap, and the width of said space or gap is from one eighth to one half an inch between opposing outer and inner surfaces of said shaft and cylindrical tube respectively; and a vertical slot is formed in the cylindrical tube.

5. The utility land anchor as recited in claim 1, wherein a pair or blades or fins are individually secured along the cylindrical tube longitudinal axis extending upwardly from said cylindrical tube lower end and project outwardly from opposite sides thereof.

6. The utility land anchor as recited in claim 1, wherein the auger has at least one turn.

7. The utility land anchor as recited in claim 1, wherein the torque producing device includes a hand bar that has a body wherefrom hand engaging bars extend oppositely and an attachment collar that is arranged for connection to the top end of the vertical shaft.

8. The utility land anchor as recited in claim 1, wherein the torque producing device includes a body wherefrom hand engaging means extend out from opposite sides thereof and has a sided drive extending therefrom for fitting in a sided opening formed in the vertical shaft second upper end.

9. The utility land anchor as recited in claim 1, wherein the mooring line attachment device is a pair of aligned holes each formed through one of the blades or fins at their junctions with the cylindrical tube and proximate to said blades or fins lower ends.

10. The utility land anchor as recited in claim 1, wherein the mooring line attachment device includes an open U shaped body that is attached at ends thereof, to extend outwardly from, the lower end of the cylindrical tube outer surface.

11. The utility land anchor as recited in claim 10 further including, a rectangular body that is attached to the upper end of the cylindrical tube outer surface, adjacent to a second upper end of the vertical shaft, a guide pulley is pivotally mounted onto said rectangular body and a pawl, that has spaced teeth formed along a side, is pivot mounted onto said rectangular body to pivot towards a sheave of said guide pulley, to move teeth formed along said side of said pawl into engagement with a mooring line that has traveled through the mounting ring that is secured across said cylindrical tube and is passed around said guide pulley sheave.

12. A utility land anchor comprising, a vertical shaft having a first lower end and a second upper end, where said vertical shaft first lower end is shaped to have a pointed tip, and said vertical shaft first lower end includes an auger located on an exterior surface of said shaft, adjacent to said pointed end, and said vertical shaft second upper end includes a center longitudinal cavity formed to receive a driver fitted therein; a cylindrical tube is provided to loosely fit over said vertical shaft between said first lower and second upper vertical shaft ends in sliding relationship; at least a pair of blades or fins that are spaced equidistantly apart and are individually attached to extend outwardly from said exterior surface of said cylindrical tube, and a mooring line attachment device is fixed to said cylindrical tube exterior surface to extend outwardly from the cylindrical tube outer surface lower end; a rectangular plate is secured onto said cylindrical tube outer surface, adjacent to a second upper end of said vertical shaft; a guide pulley is pivotally mounted onto said rectangular body and a pawl, that has spaced teeth formed along a side thereof is pivot mounted onto said rectangular body to pivot towards a sheave of said guide pulley and move said teeth formed along a side of said pawl into engagement with a mooring line that has traveled through said mooring line attachment device, adjacent to said blades or fins lower ends, and is passed around said guide pulley sheave; and a torque producing device is arranged for connection to said vertical shaft second upper end, coupling into said center longitudinal cavity of said vertical shaft second upper end to provide a rotational torque to said vertical shaft.

* * * * *